United States Patent [19]

Suzuki

[11] 4,403,953

[45] Sep. 13, 1983

[54] APPARATUS AND PROCESS OF TRANSFERRING THE VESSELS IN A TUNNEL FURNACE

[75] Inventor: Sousuke Suzuki, Ichikawa, Japan

[73] Assignee: Furnace Industrial Co., Ltd., Tokyo, Japan

[21] Appl. No.: 313,572

[22] Filed: Oct. 21, 1981

[30] Foreign Application Priority Data

Oct. 21, 1980 [JP] Japan ..... 55-147900
Apr. 1, 1981 [JP] Japan ..... 56-47256

[51] Int. Cl.[3] ..... F27B 9/14; F27D 3/04; F27D 3/00

[52] U.S. Cl. ..... 432/122; 432/126; 432/239

[58] Field of Search ..... 432/11, 122, 126, 239

[56] References Cited

U.S. PATENT DOCUMENTS 2,010,295 8/1935 Dreffein ..... 432/239
2,045,920 6/1936 Parmelee ..... 432/126
2,978,237 4/1961 Frank ..... 432/122
4,205,935 6/1980 Edler ..... 432/122

OTHER PUBLICATIONS

Chapter 3, (pp. 273–285, of "Industrial Electric Furnaces and Appliances", published 1960.

*Primary Examiner*—John J. Camby
*Attorney, Agent, or Firm*—Fleit, Jacobson & Cohn

[57] ABSTRACT

A transfer apparatus of vessels in a tunnel furnace with a built-in heating apparatus is disclosed, comprising a horizontally reciprocative apparatus for carrier apparatus and vertically reciprocative apparatus for vessels. The vessels forward one stroke together with the carrier apparatus when the carrier apparatus forwards, and the vessels are lifted up during returning the carrier apparatus to the former portion, then the vessels are felled on the returned carrier apparatus. The vessels forward one stroke at every one reciprocation movement of the carrier apparatus during backing or heating treatment of material contained in the vessels in the furnace.

3 Claims, 12 Drawing Figures

APPARATUS AND PROCESS OF TRANSFERRING THE VESSELS IN A TUNNEL FURNACE

FIELD OF THE INVENTION

The present invention relates to an apparatus and process of transferring the vessels in a tunnel furnace and making predetermined treatment for baking or heating the material which should be treated in the vessel during transferring process through the tunnel furnace, more particularly to a novel apparatus and process using heat-resisting and reciprocative flat carrier apparatus on which the vessels contained material to sinter ferrite, to bake materials for porcelain product, or to bake glass products of braun tubes and other products, or to rectify the distortion of products are placed.

BACKGROUND OF THE INVENTION

Generally speaking, since the ceramic product such as the ceramic condenser or the like must be baked at very high temperature of about 1,300 degrees centigrate, the vessel which contains such material must be made from such ceramic material to be good enough for such high temperature. And a carrier means or other means in a tunnel furnace must be good enough for such high temperature, too. But, as the ceramic product will easily be broken by a shock or mechanical force, such ceramic vessel can not be pushed out through the furnace by pushing means, also if shock or vibration is given to the material in the vessel during baking process, the product would happen inhomogenization therein.

In a conventional tunnel furnace, as a carrier means for transferring the vessels contained the material for product to be baked and heated, slide plate means as a carrier or an endless conveyer made from chain with a metal net attachment in exchange for the slide plate means is used. The slide plate must be made from peculiar brick by heat-resisting and unworn or untorm material, and the furnace floor boarding must be also made from such same special brick. In the furnace, many slide plates are connectingly provided on the furnace floor boarding, then the carrier is pushed in due course from an inlet side to an outlet side by a pushing means equipped with at out side of the inlet. In accordance with movement of the carrier, the vessels mounted on the carrier are forwarded and transferred through the tunnel furnace.

By this conventional method of transfer, the transfer means which mounted the vessels is entered in due order into the furnace from the inlet thereof and come out from the outlet, and after the sliding plate mounted the vessels come out the furnace, the empty vessels which the baked products was taken out therefrom and sliding plate for transfer means are recycled to the inlet through the out side of the furnace by means of an endless conveyer equipped with at out of the furnace. Therefore, enormous volume of heat releases from the carrier means during retransferring operation at the out side of the furnace, since the conventional apparatus is one way operation for recycling the carrier means. Consequently, further auxiliary heating in the furnace is required to heat the carrier means. Accordingly, heat energy for auxiliary heating is vainly spent in the conventional transfer means.

Also in the conventional furnace, since all of the carrier means is passed at the most high temperature center portion in the furnace and all of the carrier means is required to be made from heat-resisting material to endure the most high temperature, the cost for making the carrier means is very expensive. Further, sudden change in the temperature shortens the carriers' life, since the carriers are passed through the most high temperature portion and come out from the outlet, then the carriers cool by the atmosphere and are reentered from the inlet of the furnace in accordance with the recycle operation.

And then, in the conventional transfer method there are some important problems that, in case where the vessels are heaped up on the carrier means in the furnace providing the predetermined temperature characterization and the vessels receive heating or baking treatment, the heat to the lower vessel conducts to it through and after heating the carrier, therefore, effect for rising and falling the temperature to the lower vessel gets late in comparision with the upper vessels. The difference of the baking condition of the material between the heaped up vessels occurs. Especially, after heating the material up to the most high temperature, the homogenous products could not be obtained, because the lower vessel is over heated by heat of the carrier means.

SUMMARY OF THE INVENTION

The apparatus and process of transferring the vessel of the present invention comprises substantially reciprocative carrier means and lifting apparatus of the vessels in the tunnel furnace. The transfer means such as slide plates, belt or chain is always placed and is reciprocated in the furnace, and only vessels are entered and forwarded from the inlet into the furnace and come out from the outlet after completion of treatment, then the empty vessels are retransferred to the inlet by a circulating conveyer and are contained new material.

In accordance with this invention, heat of the carrier is not released to the out side of the furnace, and heat energy for auxiliary heating is saved, then the carrier's life is lengthened by slight change of temperature, and also the contained material in the vessels which are placed on the carrier is evenly treated. The contained material in the heaped up vessels is evenly treated, since the temperature condition of heating the vessels heaped up on the carrier is evenly controlled.

Accordingly, a principal object of the present invention is to provide an apparatus and process of transferring the vessel on a reciprocative carrier means in the tunnel furnace, and of subsequently lifting the vessels therein during returning the carrier means to a former position for one stroke.

Another object of the present invention is to provide an apparatus and process of transferring and recycling only the vessels and reciprocating the carrier means almost of which is always stayed in the furnace.

A further object of the present invention is to provide an apparatus and process of transferring the carrier means and the vessels to prevent from release of heat of the carrier means.

A still further object of the present invention is to provide an apparatus and process of transferring the carrier means and the vessels to make even heat treatment to material contained in the vessels.

Other objects and many of the attendant advantages of this invention will be readily appreciated as the same become better understood by reference to the following description on bases of the attached drawings.

BRIEF DESCRIPTION OF THE DRAWINGS

The accompanying drawings illustrate the preferred embodiments of the present invention. In the drawings, the same reference numerals illustrate the same parts of the invention, in which.

DETAILED DESCRIPTION OF THE INVENTION

Figure 1:
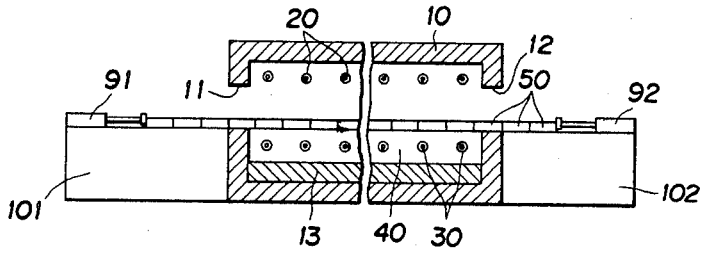
FIG. 1 is partly longitudinal sectional fragmentary schematic illustration of the present invention showing the tunnel furnace having transfer means.
Figure 2:
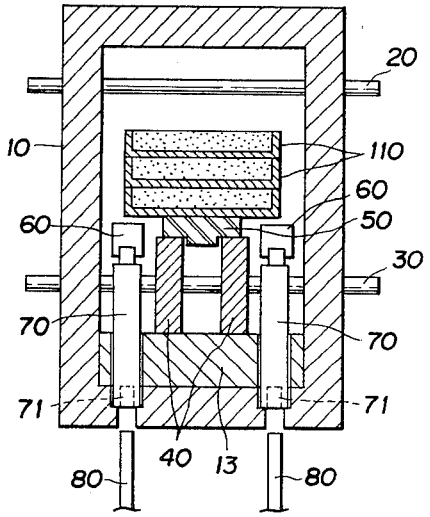
FIG. 2 is a vertical sectional side elevation showing the main construction of the furnace providing transfer means comprising a carrier and respectively one pair of the rails and elevetor rods with a pair of supporting means.
Figure 3:
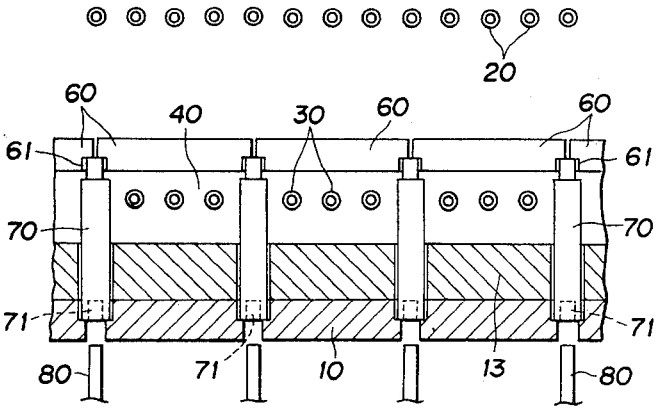
FIG. 3 is partly sectional fragmentary schematic illustration showing the lifting condition of the supporting apparatus of the vessel of the present invention.

Referring to the drawings, there is shown according to some preferred embodiments of the invention. As shown in FIGS. 1 to 3, a housing of a tunnel furnace 10 is made from heat-resisting brick or the like. The furnace has a base 13 which is predetermined preferable high and is made from same heat-resisting material as the housing and is longitudinally horizontal provided in the furnace. Heat sources 20, 30 such as electric heaters are transversely provided at preferable intervals at just above the base 13 and under a ceiling of the housing.

A transfer apparatus of the present invention comprises horizontally reciprocative apparatus for carrier apparatus and vertically reciprocative apparatus for supporting means.

A pair of skid rails 40 which is made from heat-resisting and abrasion-proof material such as silicon carbide is longitudinally installed in parallel with regular width as guide means on the base 13. A carrier consists of many slide plates 50 which are adjacently connected each other and are made from the same material as the skid rails. The carrier of slide plates 50 is slidably longitudinally mounted on the rails 40.

Elevator rods 70 which have predetermined length are respectively movably provided between each skid rail 40 and a vertical side wall of the housing through the base in parallel at preferable intervals. The rod 70 is made from heat-resisting and abrasion-proof material and is formed the head with small diameter than the body and is formed a vertical hole 71 at the lower portion. Supporting means 60 are formed cut out portions 61 at both ends and are fitted on the elevator rods 70 to be engaged the head of the rod in the hole 61 to rise and down with the rods 70.

A boost rod 80 which has predetermined length is vertically movably provided under the each elevator rod 70. A head of the boost rod 80 is engaged with the hole 71 of the rod 70.

Under the boost rods 80, driving means which are not shown in the drawings are installed intermittently to rise and down the boost rods 80 by means of well known cam apparatus, gear means, oil pressure cylinders or the combination thereof.

Work stands 101, 102 which have same height of the skid rail 40 are provided at out side of the inlet 11 and the outlet 12 of the furnace 10. On the work stands 101, 102, push apparatus 91, 92 for the slide plates 50 are oppositely equipped reciprovatively to move the slide plates 50.

With regard to relationship between the push apparatus 91, 92, and the elevator rods 70 and the boost rods 80, after completion of forwarding operation of the carrier 50 by the push apparatus 91 at the out side of the inlet 11 of the furnace 10, the boost rods 80 force up the elevator rods 70 and the supporting means 60 with vessels 110 are lifted up by the elevator rods 70, then the carrier 50 is returned by pushing operation of the another push apparatus 92 which is installed at the out side of the outlet 12 of the furnace 10. This serial movement of the members is automatically repeated as caused in due order and is controlled by electric or mechanical apparatus which is not shown in the drawings.

The vessel 110 is made from heat-resisting material such as ceramic or the like, in which materials, for example, of electronic parts such as ceramic condenser are contained.

Figure 4:
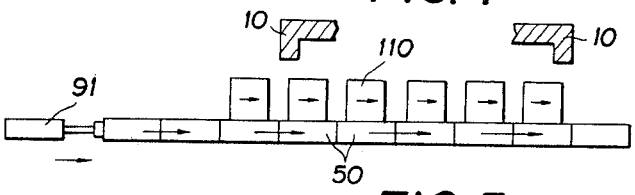
FIG. 4 is a schematic illustration showing the first operation of transferring and forwarding manner of the vessels.

The operation of the apparatus is explained: As shown in FIG. 2, the carrier 50 is slidably mounted on the skid rails 40, and as shown in FIG. 4, vessels 110 which contains the material to be made baking or heating treatment are placed on the upper surface of the carrier of slide plates 50.

By the first operation, the push apparatus 91 of the out side of the inlet 11 of the furnace 10 pushes the end of the end slide plate 50 to inward direction of the furnace and the slide plates 50 and the vessels 110 thereon are incorporatedly forwarded as shown by arrow heads.

Figure 5:
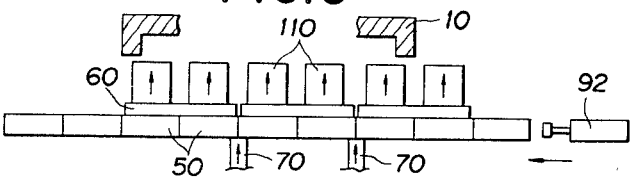
FIG. 5 is schematic illustration showing the second operation and third operation of lifting up the supporting means and the vessels and returning manner of the carrier, the former shows the lifting up condition of the vessels and the latter shows returning manner of a carrier.

After completion of the first operation, by the second operation as shown in FIG. 5, the elevator rods 70 evenly rise up in accordance with forcing up movement of the boost rods 80, then the supporting means 60 and the vessels 110 which are placed thereon are lifted up by the elevator rods 70 as shown by arrow heads directed upwardly. Therefore, the vessels 110 part from the carrier 50.

When the second operation is completed, by the third operation as shown in FIG. 5, the push means 92 of the out side of the outlet of the furnace 10 pushes inwardly the another end of slide plate 50 at the outlet portion of the furnace 10 as shown by an arrow head directed to left side, then the carrier of slide plate 50 returns to the former portion.

Figure 6:
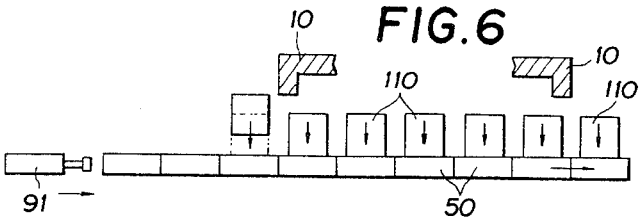
FIG. 6 is schematic illustration showing the fourth operation of falling down of the vessels and forwarding the carrier as shown in FIG. 4.

After completion of the third operation, by the fourth operation as shown in FIG. 6, the elevator rods 70 and the supporting means 60 with the vessels 110 wholly fall to the former portion on the carrier as shown by arrow heads directed downwardly in accordance with downing movement of the boost rods 80.

As described above, the carrier of the slide plates 50 was returned to the former portion by the third operation, the place where the vessels 110 fell on the slide plates 50 is one stroke forwarded portion to the outlet 12 of the furnace 10, accordingly as result, the vessels 110 were forwarded one stroke to the outlet 12. The end vessel 110 at the outlet side of the furnace 10 is pushed out from the outlet 12, and at the time, the required baking or heating treatment was already finished during passing through the furnace 10.

Therefore, as shown in FIG. 6, the end slide plate 50 of the inlet side is empty and subsequently a new vessel 110 contained material for heating treatment is placed on the empty slide plate 50 as shown by an arrow head of the left side directed downwardly.

One rotation of the operation is completed by this step. And again the first new operation will be started for a next rotation as shown in FIGS. 6 and 4 by arrow heads directed to the right side therein. This serial rotation is repeatedly cycled and the vessels 110 are forwarded in due order from the inlet 12 of the furnace.

As described above, the carrier of slide plates 50 reciprocates on the skid rails 40 in accordance with pushing operations by both the push apparatus 91, 92, then the vessels 110 placed on the carrier 50 are forwarded one stroke as a whole when the carrier 50 forwards. On the other hand, during lifting up the vessels and returning of the carrier 50 to the former portion, the vessels 110 receive direct heating treatment from the under surface thereof in addition to the other surfaces.

In the first embodiment of the present invention, the transfer apparatus comprises a pair of skid rails 40, a carrier, pushing apparatus, and plural of the supporting means and lifting apparatus of vertically slidable rods.

Referring to the drawings, the other embodiment of the transfer apparatus is shown in FIGS. 7 to 11. Turning to the FIGS. 7 and 8, the heat sources 20, 30 are transversely provided at preferable intervals in the furnace as the same manner shown in the first embodiment. A receiving means 51 of a carrier is longitudinally provided through the furnace 10 and both ends thereof extend respectively to both the out sides from the inlet 11 and the outlet 12 of the furnace 10. The receiving means is flat and is made from heat-resisting material such as stainless steel or the like.

A carrier 52 is longitudinally, horizontally, movably placed on the upper surface of the receiving means 51. The carrier 52 is formed by a belt means made from a heat-resisting serial metal net or flat plate or the like, and has a predetermined width. A pair of driving apparatus 93, 94 is respectively installed on the transfer line at both out sides of the inlet 11 and outlet 12 of the furnace, and both ends of the carrier 52 are respectively connected to the driving apparatus 93, 94, then the carrier 52 can be slidably moved on the receiving means 52 by reciprocal pulling operation of the driving apparatus 93, 94.

Figure 7:
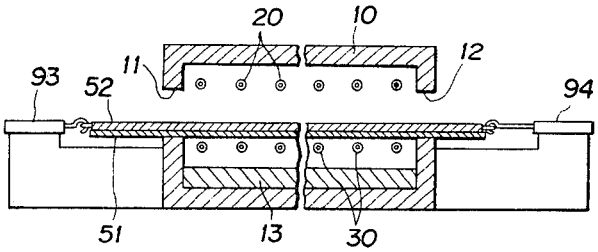
FIG. 7 is partly longitudinal sectional fragmentary schematic illustration of the other embodiment of the present invention showing the tunnel furnace providing the other transfer means.
Figure 8:
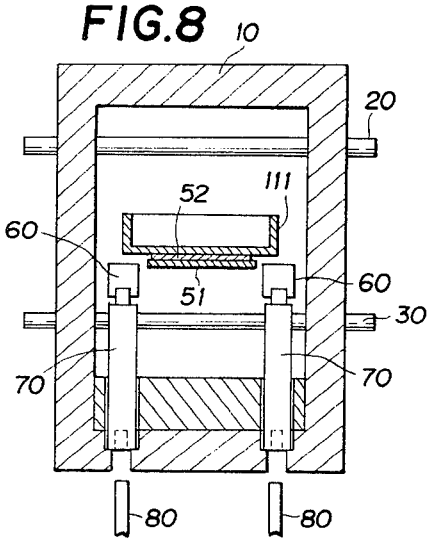
FIG. 8 is vertical sectional side elevation showing one carrier plate as the transfer means and one pair of elevetor rods.

As the same manner described above with regard to FIGS. 1 and 2, lifting means for the vessels 111 and the supporting means 60 thereof are shown in FIGS. 7 and 8.

Elevator rods 70 which have predetermined length and respectively are movably provided at both inner sides apart from the walls of the housing through the base 13 in parallel at preferable intervals. The each rod 70 is made from heat-resisting and abrasion-proof materials and is formed the head with small diameter than the body and is formed a vertical hole 71 at the lower portion. Supporting means 60 are formed cut out portions 61 at both ends and are horizontally fitted on the elevator rods 70 to be engaged the head of the rod in the cut out portion 61 to rise and down with the rods.

Each boost rod 80 which has predetermined length is vertically movably provided under the each elevator rod 70. A head of the boost rod 80 is engaged with the hole 71 of the rod 70.

Under the boost rods 80, driving means which are not shown in the drawings are installed intermittently to rise and down the boost rods by well known cam apparatus, gear means, oil pressure cylinders or the combination thereof.

Work stands are provided at both out sides of the inlet 11 and outlet 12 of the furnace 10. On the work stands, as above described, driving apparatus 93, 94 for the carrier 52 are oppositely equipped reciprocatively to pull the carrier 52.

With regard to relationship between the driving apparatus 93, 94 and elevator rods 70 and boost rods 80, after completion of forwarding operation of the carrier 52 by driving apparatus 94 at the out side of the outlet 12 of the furnace 10, the boost rods 80 force up the elevator rods 70 and the supporting means 60 with vessels 111 are lifted up by the elevator rods 70, then the carrier 52 is returned by pulling operation of the another driving apparatus 93 which is installed at the out side of the inlet 11 of the furnace 10. This serial movement of the members is automatically repeatedly caused in due order and are controlled by an electric or mechanical apparatus which is not shown in the drawings.

The vessel 111 is made from heat-resisting material such as ceramic or the like, in which materials, for example, of electronic parts such as ceramic condenser are contained.

The operation of the apparatus is explained: As shown in FIG. 7, the carrier 52 is slidably mounted on the receiving means 51, and as shown in FIG. 9, vessels 111 which contain the material to be made baking or heating treatment are placed on the upper surface of the carrier 52.

Figure 9:
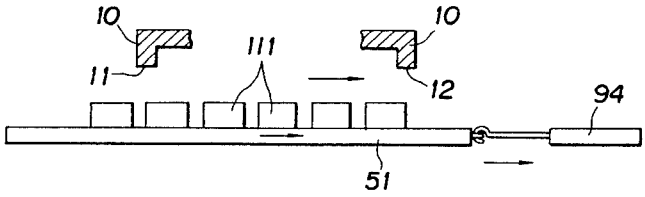
FIG. 9 is a schematic illustration showing the first operation of transferring and forwarding manner of the vessels.

By the first operation, the driving apparatus 94 of the out side of the outlet 12 of the furnace 10 pulls the end of the carrier 52 to outward direction of the furnace, and the carrier 52 and the vessels 111 thereon are forwarded together with as shown by arrow heads as shown in FIG. 9.

Figure 10:
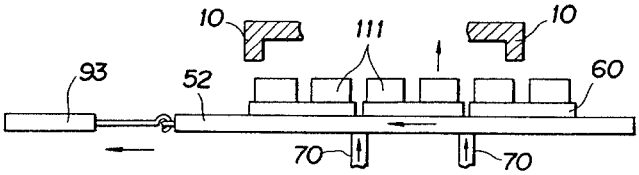
FIG. 10 is schematic illustration showing the second operation and third operation of lifting up the supporting means and the vessels and returning manner of the carrier as same as shown in FIG. 5.

After completion of the first operation, by the second operation as shown in FIG. 10, the elevator rods 70 evenly rise up in accordance with forcing up movement of the boost rods 80, then the supporting means 60 and the vessels 111 which are placed thereon are lifted up by the elevator rods 70 as shown by an arrow head directed upwardly. Therefore, the vessels 111 part from the carrier 52.

When the second operation is completed, by the third operation as shown in FIG. 10, the pull driving apparatus 93 of the out side of the inlet 11 of the furnace 10 pulls outwardly the another end of the carrier 52 at the inlet portion of the furnace 10 as shown by an arrow head directed to left side, then the carrier 52 slidably returns to the former portion.

Figure 11:
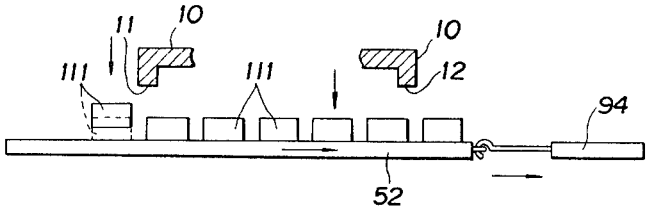
FIG. 11 is a schematic illustration showing the fourth operation of falling down of the vessels and forwarding the carrier as same as shown in FIG. 6.

After completion of the third operation, by the fourth operation as shown in FIG. 11, the elevator rods 70 and the supporting means 60 with the vessels 111 wholly fall to the former portion on the carrier as shown by an arrow head directed downwardly in accordance with dowing movement of the boost rods 80.

As described above, the carrier 52 was returned to the former portion by the thirds operation, the place where the vessels 111 fell on the carrier is one stroke forwarded portion to the outlet 12 of the furnace 10, accordingly as result, the vessels 111 were forwarded one stroke to the outlet 12. The end vessels 111 at the outlet side of the furnace 10 is pulled out from the outlet 12, and at that time the required baking or heating treatment was already finished during passing through the furnace 10.

Therefore, as shown in FIG. 11, the end portion of the carrier 52 at the inlet side is empty and subsequently a new vessel 111 contained material for heating treatment is placed on the empty portion as shown by an arrow head of the left side directed downwardly.

One rotation of the operation is completed by this step. And again, the first new operation will be started for next rotation as shown in FIGS. 11 and 9 by arrow heads directed to the right side therein.

This serial rotation is repeatedly cycled, and the vessels 111 are forwarded in due order from the inlet 11 of the furnace.

As described above, the carrier 52 reciprocates on the receiving means 51 in accordance with respectively pulling operations by both the driving apparatus 93, 94, then the vessels 111 placed on the carrier 52 are forwarded one stroke as a whole when the carrier 52 forwards. On the other hand, during lifting up the vessels and returning of the carrier 52 to the former portion, the vessels 111 receive direct heating treatment from the under surface thereof in addition to the other surfaces.

Instead of the pull driving apparatus, cam means which coacts with driving means or other reciprocating apparatus can be utilized to move reciprocatively the carrier for one stroke. When the material to be received the treatment is larger than the general size vessel 111, a large containers are utilized for such large material. If the large containers is not supported on the supporting means 60, the elevator rods 70 should be lengthened, then horizontal arms should be oppositely equipped respectively on the head of elevator rods to hold the containers between the opposite arms. By the arms, the containers can be lifted up from the carrier during returning the carrier to the former portion. And the containers are fallen on the carrier and forwarded one stroke by same manner as described above.

Figure 12:
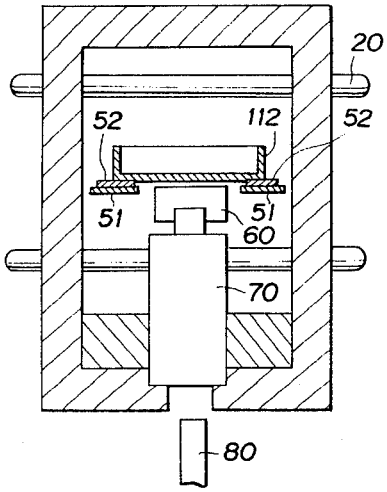
FIG. 12 is vertical sectional side elevation showing the other embodiment of the carrier means providing a pair of the carrier plates, and of one elevator rod.

In FIG. 12, the other embodiment of the transfer means is shown. In this embodiment, each one pair of the receiving means 51 and of the carriers 52 is respectively provided at both sides in parallel, and supporting means 60, elevator rods 70 and boost rods 80 are provided at center portion and between both transfer apparatus to lift up the vessels 112 from the center portion thereof. This embodiment requires only half number of the apparatus and means in comparison with the other embodiments of the present invention.

Instead of the elevator rods, boost rods and driving means thereof, other hanger apparatus which is not shown in the drawings can be utilized in or through the furnace to hang up the supporting means 60 during returning the carrier 52 to the inlet 11 direction. By this hanger apparatus, the same effects of the above described embodiments can be obtained, too.

In the above described second and third embodiments, the each carrier which is comprised heat-resisting belt means of metal net or flat plate is reciprocatively moved with alternately pulling operation of both the ends thereof, and the carrier which is placed the vessels thereon is constructed to move smoothly and not to suspend by the weight of the vessels on the receiving means 51. Instead of this embodiment, other apparatus which is not shown in the drawings can be provided, that is, a pair of chains or endless chains as the carrier is longitudinally laid in parallel to be able to mount the vessels, and reinforce rods are fitted under and along the chain means as the receiving means. Further, the carrier which is made from enough strong material and sliding apparatus such as rollers to contact with the under surface of the carrier are respectively available. In this case, the carrier can be reciprocated by not only pulling operation but also pressing operation which is alternately caused.

It will be well understood that the construction of the above described embodiments which the supporting means are boosted up by the elevator rods is able to be changed to other construction which the supporting means are rised and downed in condition that the supporting means are supported from both sides in the furnace, and that the longitudinally separated supporting means are replaced with one supporting means constructed as one body for one side supporting means, also that the furnace can be provided other heating system of combusion apparatus of oil or the like in lieu of the electric heater.

In accordance with the present invention, it is possible for the carrier to reciprocate in the furnace by means of the driving apparatus which are oppositely installed at both out sides of the inlet and the outlet of the of the furnace, therefore, only the vessels can be forwarded in due order and almost of the carrier always stays in the furnace. Accordingly, it is possible not to release the heat of the furnace, particularly, heat of the carrier is prevented from release to the atmosphere and it is not necessary to make preheating treatment to the carrier when the carrier is reentered to the furnace in comparison with the conventional tunnel furnace. Also vain heat energy of preheating the carrier is saved, then it can be promoted the effects of saving energy, in addition, the number of the slide plates used in this invention can be reduced than the convention apparatus in which the slide plates automatically recycle through out of the furnace, so it can also be reduced the costs of the equipment.

Only the specific portion of the carrier where it reciprocates in the furnace is heated at high temperature, accordingly such specific portion of the carrier, that is, belt, chain or the like can be made from the selected material for each portion with regard to the heating temperature distribution. In addition, the carrier's life is lengthened by slight change of temperature thereon, since as described above, the specific portion of the carrier is always placed in the almost fixed range of temperature.

From the present invention, since the each portion of carrier is respectively reciprocated in the limited distance providing predetermined heating temperature distribution by considerable arrangement of the heaters, the each portion of the carrier is respectively differently heated to suite with the required temperature.

As the vessels are lifted up at every reciprocative stroke, of the carrier, it is well ventilated between the carrier and the vessels, so temperature of both the vessels and carrier approach to the required heat temperature at the specific portion in the furnace, then, all of the vessels is evenly progressed the required heating treatment in rising and falling temperature circumstances in accordance with the predetermined heating temperature distribution, even if the vessels are heaped up. Therefore, as results, the materials which is contained in the vessels is evenly treated for baking and heating thereof as required and the quality of the product is raised.

The present invention improved defective points of the conventional furnace that the transferring speed have to be delayed either or the length of the furnace have to be extended by the reasons that the length of the furnace and the time for transferring the vessels contained material have to be set up on the basis of the lower vessel which are heaped up and are not readily effected in proportion to change of temperature, then it is possible to reduce and save the required energy and to raise productivity than the conventional furnace.

Furthermore, this kind of the tunnel furnace has the specific temperature distribution characteristic that the center portion thereof is heated to high temperature and both sides to the inlet and the outlet directions are put down temperature than the center portion step by step, particularly at the outlet the heater is not provided in order to cool the product by the atmosphere. Therefore, when the present transfer apparatus and process are applied to such tunnel furnace, the carrier which is more heated is returned to the former portion of the inlet side from the inner portion, accordingly vain heat energy for additional heating of the carrier is saved.

On the other hand, where the carrier is returned on the same line, the outlet portion and adjacent portion in the furnace are put down temperature step by step, and the carrier is not steeply downed temperature, accordingly such falling temperature does not influence quality of the production and is not disadvantageous, since there is almost no loss of energy.

As the transfer apparatus of the present invention is repeated the horizontal and vertical reciprocation, it is expected not only drastic reduction of costs for equipment but also improvement of durability of the carrier and progression of quality of the products, and there is not damages to the carrier and to the products in comparison with the conventional apparatus of one way conveyer system such as a general conveyer, since the transfer apparatus of the present invention do not cycle to only one way and there is no meandering movement of the carrier by difference of the size between the right and left sides of the carrier and unparallelled rolls. Particularly, the present invention has remarkable effects on treatment of the large product for baking the braun tubes or rectifing the distortion of the glass product.

Although only limited preferred embodiments of the invention have been illustrated and described, it is anticipated that various changes and modifications will be apparent to those skilled in the art, and that such changes may be made without departing from the scope of the invention as defined by the following claims.

What is claimed is:

1. A transfer apparatus for transferring vessels through a tunnel furnace having a built-in heating apparatus, the vessels having predetermined widths, said transfer apparatus comprising:

carrier receiving means extending horizontally between an inlet and an outlet of the furnace for supporting carrier slide plates;

a plurality of carrier slide plates made from heat-resisting and abrasion-proof material and adjacently connected to each other, said carrier slide plates being slidably mounted on the carrier receiving means, having upper surfaces supporting said vessels, and having smaller widths than the widths of the vessels and being longitudinally reciprocative in the furnace on the carrier receiving means;

vertically movable lifting means for lifting vessels off of said carrier slide plates so that said carrier slide plates are horizontally movable with respect to the lifted vessels, said lifting means being operable to return the lifted vessels to the carrier slide plates;

supporting means mounted on the lifting means for engaging portions of the vessels protruding from side edges of said carrier slide plates to thereby support the vessels during lifting movement thereof; and drive means for horizontally moving said carrier slide plates, said carrier slide plates being moved in a first direction to incrementally advance vessels through said tunnel furnace and being moved in a direction opposite said first direction after the vessels have been lifted off of said carrier slide plates.

2. A transfer apparatus according to claim 1, wherein said carrier receiving means comprises at least one rail which extends longitudinally within the furnace.

3. A transfer apparatus according to claim 1, wherein the lifting means comprises at least one reciprocatable rod having an upper end thereof engageable with the supporting means and having a lower end thereof extending slidably vertically through a base of the furnace, said apparatus further comprising means engageable with the lower end of said rod for vertically reciprocating said rod.

* * * * *